US009166293B2

(12) United States Patent
Huang et al.

(10) Patent No.: US 9,166,293 B2
(45) Date of Patent: Oct. 20, 2015

(54) ANTENNA AND THE METHOD FOR ADJUSTING THE OPERATION BANDWIDTH THEREOF

(75) Inventors: Chih-Yung Huang, Taichung County (TW); Kuo-Chang Lo, Miaoli County (TW)

(73) Assignee: Arcadyan Technolgy Corporation, Hsinchu (TW)

( * ) Notice: Subject to any disclaimer, the term of this patent is extended or adjusted under 35 U.S.C. 154(b) by 423 days.

(21) Appl. No.: 13/184,826

(22) Filed: Jul. 18, 2011

(65) Prior Publication Data

US 2012/0249377 A1 Oct. 4, 2012

(30) Foreign Application Priority Data

Apr. 1, 2011 (TW) ..... 100111698 A

(51) Int. Cl.
*H01Q 1/24* (2006.01)
*H01P 11/00* (2006.01)
*H01Q 9/04* (2006.01)

(52) U.S. Cl.
CPC ..... *H01Q 9/0421* (2013.01); *Y10T 29/49016* (2015.01)

(58) Field of Classification Search
CPC .... H01Q 9/0421; H01Q 9/0414; H01Q 13/10
USPC ..... 343/702, 700 MS
See application file for complete search history.

(56) References Cited

U.S. PATENT DOCUMENTS 6,894,647 B2 * 5/2005 Jenwatanavet ..... H01Q 9/0421 343/700 MS
7,161,540 B1 1/2007 Liu
7,230,571 B2 * 6/2007 Gaucher et al. ..... 343/702
7,495,630 B2 * 2/2009 Hu et al. ..... 343/846
7,602,341 B2 * 10/2009 Wei-Shan et al. ..... 343/702
8,040,283 B2 10/2011 Cheng et al.
8,390,519 B2 * 3/2013 Wang ..... H01Q 9/0421 343/700 MS
2005/0007279 A1 * 1/2005 Chang ..... H01Q 1/243 343/700 MS
2007/0279312 A1 * 12/2007 Mei et al. ..... 343/700 MS
2008/0122701 A1 * 5/2008 Kan et al. ..... 343/700 MS
2008/0180339 A1 * 7/2008 Yagi ..... H01Q 9/0421 343/700 MS (Continued)

FOREIGN PATENT DOCUMENTS

CN 101777699 7/2010
TW I254493 5/2006

(Continued)

OTHER PUBLICATIONS

CN Office Action dated Jul. 10, 2014 for corresponding PRC application.
Corresponding Taiwan Patent Application Office Action, Taiwan Patent Office, Oct. 7, 2014.

*Primary Examiner* — Sue A Purvis
*Assistant Examiner* — Michael Bouizza
(74) *Attorney, Agent, or Firm* — Gottlieb, Rackman & Reisman P.C.

(57) ABSTRACT

A method for adjusting an operation bandwidth of an antenna is provided. The antenna includes a radiation element, and the radiation element includes a first adjusting portion having a first width and a second adjusting portion having a second width. The method includes steps of seeking an operation frequency of the antenna; and adjusting the operation bandwidth of the antenna by adjusting the second width based on the operation frequency.

19 Claims, 7 Drawing Sheets

(56) References Cited

U.S. PATENT DOCUMENTS

| | | | | |
|---|---|---|---|---|
| 2010/0045564 | A1* | 2/2010 | Chih-Yung et al. | 343/893 |
| 2010/0164821 | A1* | 7/2010 | Huang | 343/846 |
| 2011/0273352 | A1* | 11/2011 | You | H01Q 9/42 343/834 |

FOREIGN PATENT DOCUMENTS

| | | |
|---|---|---|
| TW | I279031 | 4/2007 |
| TW | 200924288 | 6/2009 |

* cited by examiner

ANTENNA AND THE METHOD FOR ADJUSTING THE OPERATION BANDWIDTH THEREOF

CROSS-REFERENCE TO RELATED APPLICATION AND CLAIM OF PRIORITY

The application claims the benefit of Taiwan Patent Application. No. 10011698, filed on Apr. 1, 2011, in the Taiwan Intellectual Property Office, the disclosures of which are incorporated herein in their entirety by reference.

FIELD OF THE INVENTION

The present invention relates to an antenna and the method for adjusting the operation bandwidth thereof, especially relating to an antenna design for broadening the bandwidth of the antenna.

BACKGROUND OF THE INVENTION

Currently, various kinds of small-sized antennas are developed, to be applied to various kinds of hand-held electronic devices (e.g. the mobile phone or the notebook computer) or to the wireless transmission device (e.g. the AP). For example, the planar inverse-F antenna (PIFA) that has a light structure as well, as a good transmission efficiency and can be easily disposed on the inner wall of the hand-held electronic device, has, been widely used for various kinds of hand-held electronic devices, the notebook computer or the wireless communication device.

The current planar inverse-F antenna has a narrower bandwidth. Because the frequency of the PIFA will drift under different environments, the fine tuning for the frequency segment thereof needs to be performed under different environments. This will greatly influence the manufacturing process of the PIFA, i.e. greatly increasing the cost of the mold.

In order to overcome the drawbacks in the prior art, an antenna and the method for adjusting the operation bandwidth thereof are provided. The particular design in the present invention not only solves the problems described above, but also is easy to be implemented. Thus, the present invention has the utility for the industry.

SUMMARY OF THE INVENTION

In accordance with an aspect of the present invention, an antenna and the method for adjusting the operation bandwidth thereof are provided. The present invention can easily adjust the antenna to achieve a suitable operation frequency, and can adjust an operation bandwidth of the antenna. The antenna of the present invention is connected to an interface connection port of an electronic device. The antenna includes a radiation element and a ground, element. The radiation element includes a first adjusting portion, a second adjusting portion and a signal feeding terminal. The ground element includes a ground portion and a third adjusting portion. The ground element extends from the radiation element, and a first included angle is formed between the first adjusting portion and the second adjusting portion. The second adjusting portion extends from the first adjusting portion, and a second included angle is formed between the second adjusting portion and the third adjusting portion. A first end of the third adjusting portion extends from the second adjusting portion, and a third included angle is formed between the third adjusting portion and the ground portion. The ground portion extends from a second end of the third adjusting portion, and the first adjusting portion is disposed between the second adjusting portion and the ground portion.

In the manufacturing process of the antenna, the antenna usually has a predetermined size according to the purpose of the antenna, uses the computer modeling to obtain a mold size and the width ratio thereof according to the predetermined size, and sets a plurality of antenna parameters at the same time. The antenna parameters include an operation frequency, an operation bandwidth and an impedance matching. Through the mold size and the width ratio thereof, the antenna is obtained. The radiation element of the antenna has a total width including a first width and a second width. The first adjusting portion has the first width which is adjustable, the second adjusting portion has the second width which is adjustable, and the third adjusting portion has a third width which is adjustable. The first width is adjusted away from or toward the ground portion, the second width is adjusted away from or toward the first adjusting portion, and the third width is adjusted away from or toward the second adjusting portion.

Before the establishment of the mold, the computer modeling, is used to adjust the parameters of the antenna. The present invention sets the operation frequency of the antenna according to the relationship that a lateral length of the radiation element is one-fourth of the resonance wavelength. The lateral length is a sum of the total width and a first length from the signal feeding terminal to the edge of the first adjusting portion. For meeting the size of the electronic device, the first length is usually fixed. Therefore, the total, width is set only by adjusting the first width to obtain an operation frequency of the antenna. For example, the operation frequency is 2.45 GHz. Then, the third width is adjusted to a suitable width according to the operation frequency to obtain an impedance matching between the antenna and the electronic device. Subsequently, the total width is fixed and the second width, is adjusted, based on the operation frequency and the impedance matching, to broaden the operation bandwidth of the antenna. For example, an operation frequency band of the antenna ranges between 2.245 and 2.885. GHz, wherein the operation bandwidth thereof is up to 640 MHz. Therefore, in the process of manufacturing the mold of the antenna, the required operation frequency, the good impedance matching and the broad, operation bandwidth can be easily obtained only by the fine tuning of the respective widths of the three adjusting portions mentioned above.

The present invention provides an antenna and the method of adjusting the operation frequency thereof. The antenna is applicable to various kinds of wireless communication devices, and can be easily adjusted and modified according to the demand of the product to achieve the suitable frequency band application. Since the bandwidth of the antenna of the present invention is wider than those of other PIFAs, even if the antenna of the present invention is used under different environments, the frequency band thereof still efficiently falls within the operation frequency band. This efficiently saves the cost of manufacturing multiple molds. Besides, the antenna of the present invention is applicable to various kinds of wireless network devices, e.g. the notebook computer, the mobile phone, etc.

In accordance with another aspect of the present invention, a method for adjusting an operation bandwidth of an antenna is provided. The antenna is connected to an electronic device and includes a radiation element and a ground element, the radiation element includes a first adjusting portion having a first width and a second adjusting portion having a second width, the ground element includes a ground portion and a third adjusting portion having a third width, a first end and a second end, a first included angle is formed between the first adjusting portion and the second adjusting portion, the first adjusting portion extends from the second adjusting portion, a second included angle is formed between, the second adjusting portion and the third adjusting portion, the second adjusting portion extends from the first end of the third adjusting portion, a third included angle is formed between the third adjusting portion and the ground portion, the second end of the third adjusting portion extends from the ground portion, and the first adjusting portion is disposed between the ground portion and the second adjusting portion. The method includes steps of obtaining an operation frequency of the antenna by setting a total width being a sum of the first width and the second width based on a relationship between a resonance wavelength, of the antenna and a length of the radiation element; adjusting an impedance matching between the antenna and the electronic device by adjusting, the third width of the third adjusting portion based on the operation frequency; and adjusting the operation bandwidth of the antenna by fixing the total width and by adjusting the second width based on the operation frequency and the impedance matching.

In accordance with a further aspect of the present invention, a method for adjusting an operation bandwidth of an antenna is provided. The antenna includes a radiation element, and the radiation element includes a first adjusting portion having a first width and a second adjusting portion having a second width. The method includes steps of seeking an operation frequency of the antenna; and adjusting the operation bandwidth of the antenna by adjusting the second width based on the operation frequency.

In accordance with further another aspect of the present invention, an antenna having an operation frequency and an adjustable operation bandwidth is provided. The antenna includes a radiation element including a first adjusting portion having a first width; and a second adjusting portion having a second width, wherein the operation frequency is determined by a sum of the first, width and the second width, and the adjustable operation bandwidth, is determined by the second width.

The above objects and advantages of the present invention will become more readily apparent, to those ordinarily skilled in the art after reviewing the following detailed descriptions and accompanying drawings, in which:

BRIEF DESCRIPTION OF THE DRAWINGS

FIG. 2(*b*) shows a method, of adjusting antenna parameters of the antenna of FIG. 2(*a*);

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1A:
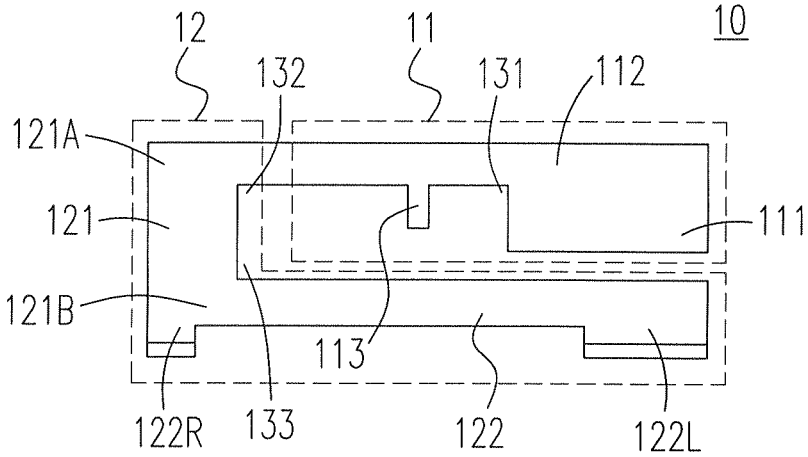
FIGS. 1(*a*)-1(*c*) show an antenna in various views according to an embodiment of the present invention.
Figure 1B:
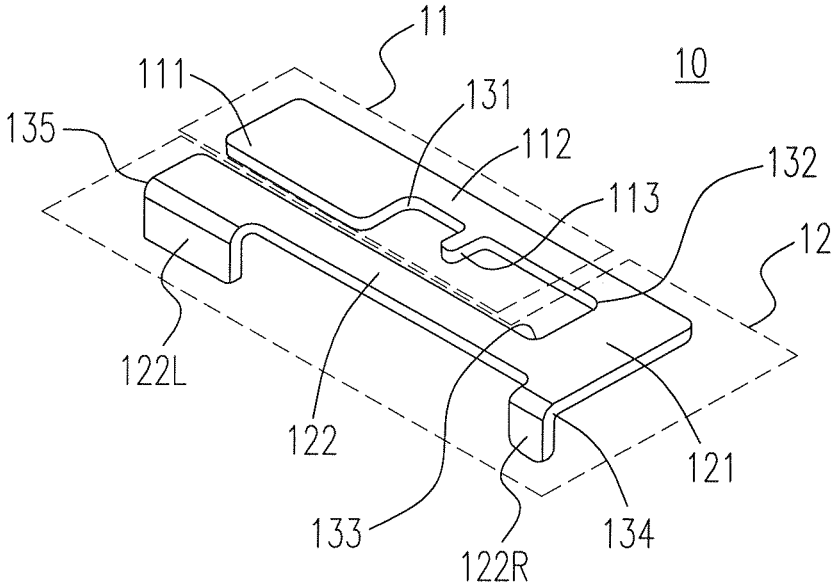
Figure 1C:
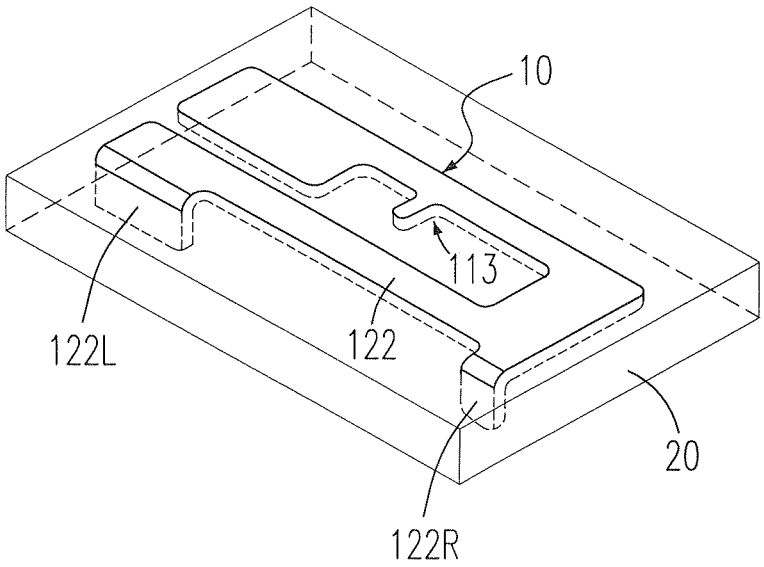

FIGS. 1(*a*)-1(*c*) show an antenna 10 in various views according to an embodiment of the present, invention. FIG. 1(*a*) shows a front view of the antenna 10, FIG. 1(*b*) shows a schematic view thereof, and FIG. 1(*c*) shows the antenna 10 connected to an interface connection port 20 of an electronic, device (not shown). For example, the electronic device can be a notebook computer or a mobile phone. As shown in FIG. 1(*a*), the antenna 10 includes a radiation element 11, a ground element 12, a first included angle 131, a second included angle 132, a third included angle 133, a fourth included angle 134 and a fifth included angle 135. For example, the antenna 10 is a sheet metal element. The ground element 12 extends from the radiation element 11. The radiation element 11 includes a first adjusting portion 111, a second adjusting portion 112 and a signal feeding terminal 113. The ground element 12 includes a third adjusting portion 121 and a ground portion 122. The ground element 12 further includes two ground terminals 122R, 122L.

A first included angle 131 is formed between the first adjusting portion 111 and the second adjusting portion 112, and the second adjusting portion 112 extends from the first adjusting portion 111. The second included angle 132 is formed between the second adjusting portion 112 and the third adjusting portion 121, and a first end 121A of the third adjusting portion 121 extends from the second adjusting portion 112. The third included angle 133 is formed between the third adjusting portion 121 and the ground portion 122, and the ground portion 122 extends from a second end 121B of the third adjusting portion 121. The third adjusting portion 121 is disposed between the ground portion 122 and the second adjusting portion 112. For example, in an embodiment, the first included angle 131, the second included angle 132 and the third included angle 133 are all 90 degrees.

The signal feeding terminal 113 extends from the lower edge of the second adjusting portion 112, and is disposed between the first adjusting portion 111 and the ground portion 122. The fourth included angle 134 is formed between the ground terminal. 122R and the third adjusting portion 121. The fifth included angle 135 is formed between the ground terminal 122L and the ground portion 122. The ground terminal 122R extends from the second end 121B of the third adjusting portion 121, and the ground terminal 122L extends from the ground portion 122. For example, in an embodiment, the fourth included angle 134 and the fifth included angle 135 are both 90 degrees.

Figure 3:
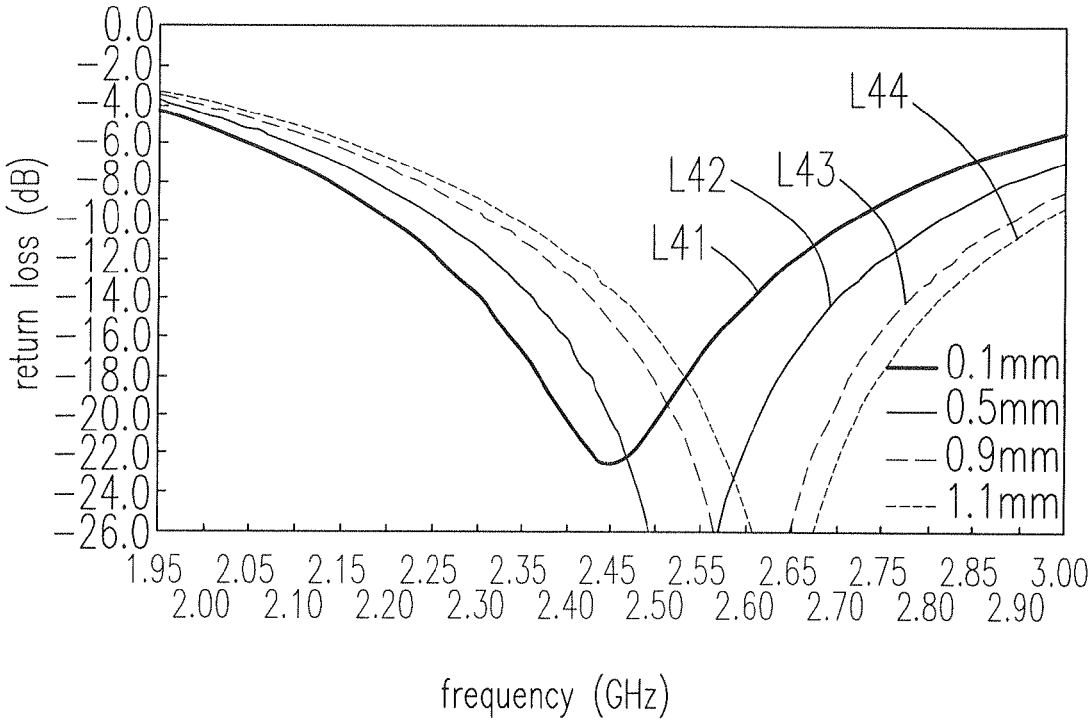
FIG. 3 shows the relationship between the return loss and the frequency when adjusting a first width of an antenna according to an embodiment of the present invention.

As shown in FIG. 3(*c*), the antenna 10 is fixed on the electronic device by inserting the two ground terminals 122R, 122L into the interface connection port 20.

Figure 2A:
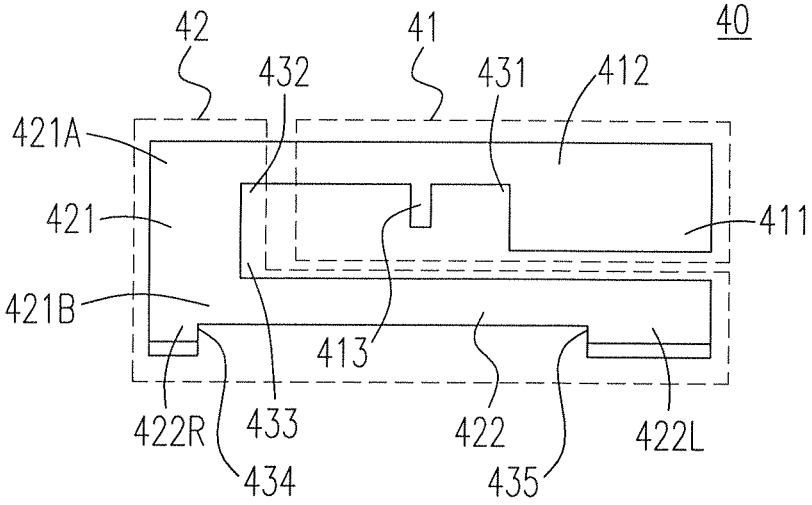
FIG. 2(*a*) is a front view of an antenna according to the present invention.
Figure 2B:
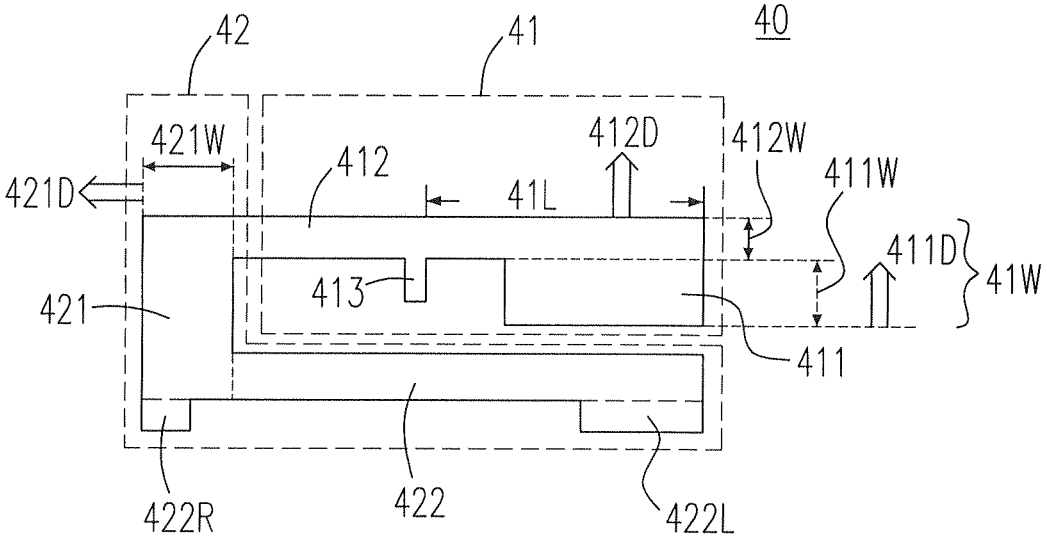

Please refer to FIGS. 2(*a*) and 2(*b*). FIG. 2(*a*) is a front view of an antenna 40 according to the present invention, and FIG. 2(*b*) shows a method of adjusting antenna parameters of the antenna 40. The antenna 40 is connected to an electronic device (not shown). As shown in FIG. 2(*a*), the antenna 40 includes, a radiation element 41, a ground element 42, a first included angle 431, a second included angle 432, a third included angle 433, a fourth included angle 434 and a fifth included angle 435. For example, the antenna 40 is a sheet metal element. The ground element 42 extends from the radiation element 41. The radiation element 41 includes a first adjusting portion 411, a second adjusting portion 412 and a signal feeding terminal 413. The ground element 42 includes a third adjusting portion 421 and a ground portion 422. The ground element 42 further includes two ground terminals 422R, 422L.

A first included angle 431 is formed between the first adjusting portion 411 and the second adjusting portion 412, and the second adjusting portion 412 extends from the first adjusting portion 411. The second included angle 432 is formed between the second adjusting portion 412 and the third adjusting portion 421, and a first end 421A of the third adjusting portion 421 extends from the second adjusting portion 412. The third included angle 433 is formed between, the third adjusting portion 421 and the ground portion 422, and the ground portion 422 extends from a second end 421B of the third adjusting, portion 421. The third adjusting portion 421 is disposed between the ground portion 422 and the second adjusting portion 412. For example, in an embodiment, the first included angle 431, the second included angle 432 and the third included angle 433 are all 90 degrees.

The signal feeding terminal 413 extends from the lower edge of the second adjusting portion 412, and is disposed between the first adjusting portion 411 and the ground portion 422. The fourth included angle 434 is formed between the ground terminal 422R and the third adjusting portion 421. The fifth included angle 435 is formed between the ground terminal 422L and the ground portion 422. The ground terminal 422R extends from the second end 421B of the third adjusting portion 421, and the ground terminal 422L extends from the ground portion 422. For example, in an embodiment, the fourth included angle 434 and the fifth included angle 435 are both 90 degrees.

As shown in FIG. 2(*b*), in the manufacturing process of the antenna, the antenna usually has a predetermined size according to the purpose of the antenna, uses the computer modeling to obtain, a mold size and the width ratio thereof according to the predetermined size, and sets a plurality of antenna parameters at the same time. The antenna parameters include an operation frequency, an operation bandwidth and an impedance matching. Through the mold size and the width ratio thereof, the antenna, is obtained. The radiation element 41 has a total width 41W including a first width 411W and a second width 412W. The first adjusting portion 411 has the first width 411W which is adjustable, the second adjusting portion 412 has the second width 412W which is adjustable, and the third adjusting portion 421 has a third width 421W which is adjustable. The first width 411W is adjusted away from or toward the ground portion 422, e.g. a first direction 411D in this embodiment. The second width 412W is adjusted away from or toward the first adjusting portion 411, e.g. a second direction 412D in this embodiment. The third width 421W is adjusted away from or toward the second adjusting portion 412, e.g. a third direction 421D in this embodiment.

Before the establishment of the mold, the computer modeling is used to adjust the parameters of the antenna. The present invention sets the operation frequency of the antenna according to the relationship, that a lateral length of the radiation element 41 is one-fourth of the resonance wavelength. The lateral length is a sum of the total width 41W and a first length 41L from the signal feeding terminal 413 to the edge of the first adjusting portion 411. For meeting the size of the electronic device, the first length 41L is usually fixed. Therefore, the total width 41W is set only by adjusting the first width 411W to obtain an operation frequency of the antenna 40. Then, the third width 421W is adjusted to a suitable width according to the operation frequency to obtain an impedance matching between the antenna 40 and the electronic device. Subsequently, the total width 41W is fixed and the second width 412W is adjusted, based on the operation frequency and the impedance matching, to adjust the operation bandwidth of the antenna 40. For example, the total width 41W is set to obtain the central operation frequency of 2.45 GHz, and a first ratio of the second width 412W to the total width 41W is set to be between 0.5 and 1. In an embodiment, when the first ratio is 0.972 and a second ratio of the second width 412W to the first width 411W is 35, the antenna 40 has a frequency band between 2.245 GHz and 2.885 GHz. In this case, the operation bandwidth of the antenna 40 is broadened up to 640 MHz. Once the operation frequency of the antenna 40 is determined, the total width 41W is fixed. Therefore, the adjustment of the first width 411W is usually inversely proportional to that of the second width 412W. For example, when the operation frequency of the antenna 40 is to be adjusted, if the second width 412W is increased, the first width 411W needs to be decreased to avoid the reduction of the central operation frequency of the antenna 40.

Besides, when the mold of the antenna 40 is completed, the operation bandwidth thereof can be increased or decreased by adjusting the first ratio of the second width 412W to the total width 41W, if necessary.

Please refer to FIG. 3, which shows the relationship between the return loss and the frequency when adjusting the first width 411W of the antenna 40 according to an embodiment of the present invention. FIG. 3 includes a plurality of response curves L41, L42, L43 and L44. As shown in FIG. 3, the second width 412W and the third width 421W are fixed, and the fine tuning is made away from the ground portion 422 and toward the first direction 411D to generate different first widths 411W, thereby generating different response curves L41, L42, L43 and L44. The total width 41W approaching a central operation frequency, i.e. D1 (mm), is obtained, wherein the total width 41W includes the first width 411W and the second width 412W. The response curve L41 is corresponding to the total width 41W of (D1−0.1) (mm), the response curve L42 is corresponding to the total width 41W of (D1−0.5) (mm), the response curve L43 is corresponding to the total width 41W of (D1−0.9) (mm), and the response curve L44 is corresponding to the total width 41W of (D1−1.1) (mm). As shown in FIG. 3, when the total width 41W is (D1−0.1), the peak of the response curve L41 is corresponding to a frequency of 2.45 GHz, which is the operation frequency to be selected.

Figure 4:
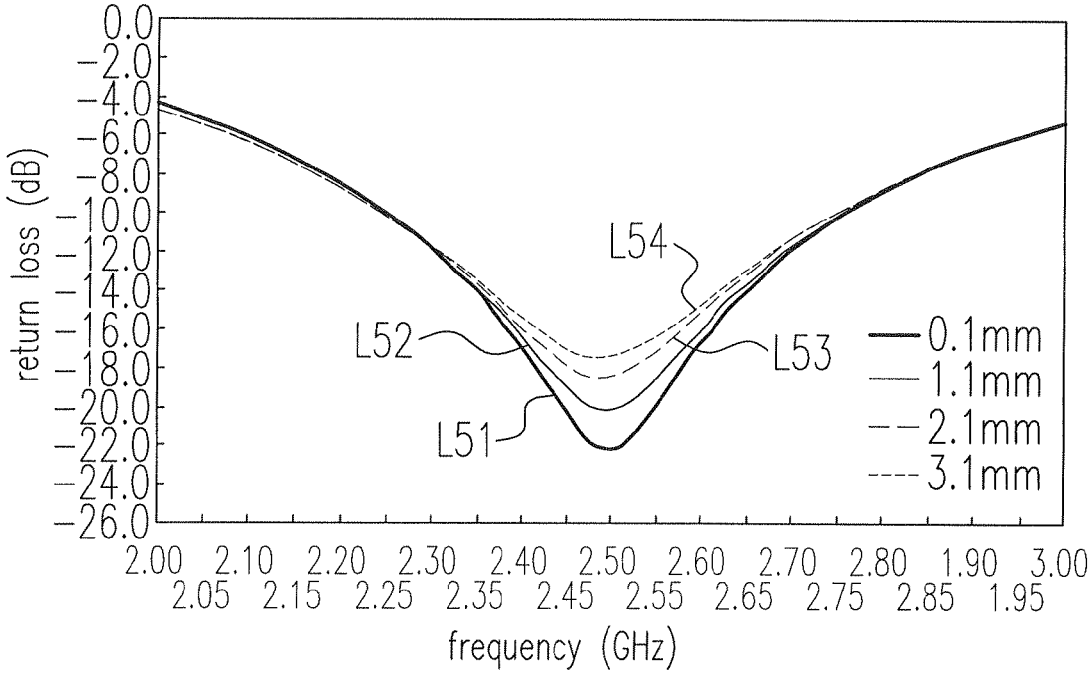
FIG. 4 shows the relationship between the return loss and the frequency when adjusting a third width of an antenna according to an embodiment of the present invention.

Please refer to FIG. 4, which shows the relationship between the return loss and the frequency when adjusting the third width 421W of the antenna 40 according to an embodiment of the present invention. FIG. 4 includes a plurality of response curves L51, L52, L53 and L54. According to the above-mentioned method, the central operation frequency is set to be 2.45 GHz by setting the total width 41W, and, the adjustment is made away from the second adjusting portion 412 and toward the third direction 421D to generate different third widths 421W, thereby generating different response curves L51, L52, L53 and L54. The third width 421W approaching the best impedance matching, i.e. D2 (mm), is obtained. The response curve L51 is corresponding to the adjusted third width 421W of (D2+0.1) (mm), the response curve L52 is corresponding to the adjusted third width 421W of (D2+1.1) (mm), the response curve L53 is corresponding to, the adjusted third width 421W of (D2+2.1) (mm), and the response curve L54 is corresponding to the adjusted third width 421W of (D2+3.1) (mm). As shown in FIG. 4, when the third width 421W is (D2+0.1), the response curve L51 has a return loss lower than those of other, response curves L52, L53 and L54. This represents that, the impedance matching between, the antenna 40 and the electronic device is the best.

Figure 5:
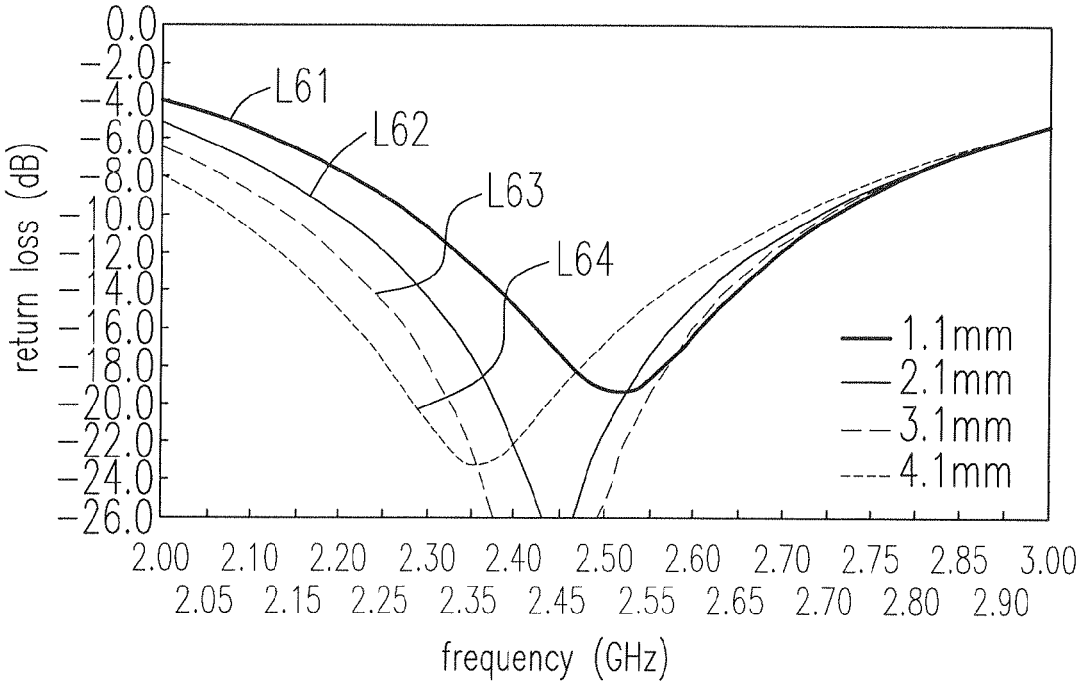
FIG. 5 shows, the relationship between the return, loss and the frequency when adjusting a second width of an antenna according to an embodiment of the present invention.

Please refer to FIG. 5, which shows the relationship between the return loss and the frequency when adjusting the second width 412W of the antenna 40 according to an embodiment of the present invention. FIG. 5 includes a plurality of response, curves L61, L62, L63 and L64. According to the above-mentioned method, the central operation frequency is set to be 2.45 GHz and a preferred impedance matching is obtained by setting the total width 41W and the third width 421W. Based on the above, the adjustment is made away from the first adjusting portion 411 and toward the second direction 412D to generate different second widths 412W, thereby generating different response curves L61, L62, L63 and L64. The response curve L61 is corresponding to the second width 412W of 1.1 (mm), the response curve L62 is corresponding to the second width 412W of 2.1 (mm), the response curve L63 is corresponding to the second width 412W of 3.1 (mm), and the response curve L64 is corresponding to the second width 412W of 4.1 (mm). As shown in FIG. 5, when the second width 412W is 4.1 (mm), the operation bandwidth formed by the response curve L64, under the same return loss, is larger than those, formed by other response curves L61, L62 and L63. For example, the operation frequency band of the antenna 40 is between 2.06 and 2.7 GHz, wherein the operation bandwidth thereof is up to 640 MHz. Accordingly, the operation bandwidth of the antenna 40 is extremely large.

Figure 6:
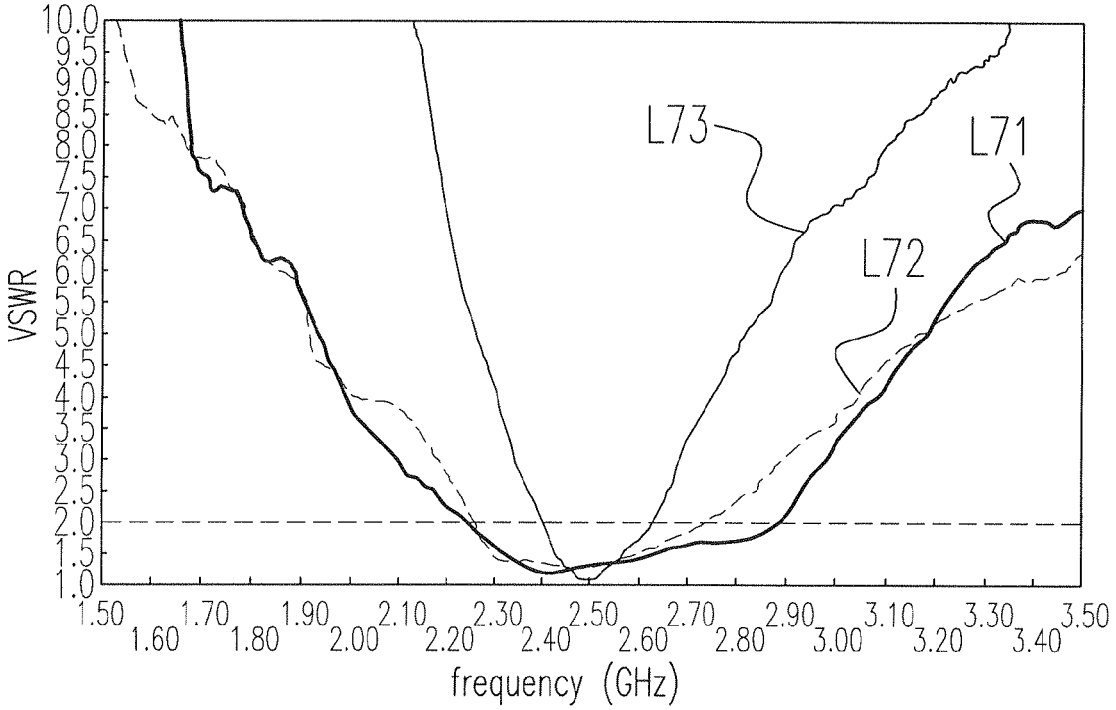
FIG. 6 shows the relationship between the VSWR and the frequency of an antenna according to an embodiment of the present invention.

Please refer to FIG. 6, which shows the relationship between the VSWR and the frequency of the antenna 40 according to an embodiment of the present invention. FIG. 5 includes a plurality of response curves L71, L72 and L73. The response curve L71 is corresponding to the antenna 40, the response curve 72 is corresponding to the sample antenna 50 (the Taiwanese Application No. 98139644), and the response curve 73 is corresponding to the sample antenna 60 (the Taiwanese Application No. 99101954). As shown in FIG. 6; when the VSWR drops below the desirable maximum value "2", the response curve L71 has a broader operation bandwidth than those of the response curve L72 and the response curve L73. The operation frequency band of the antenna 40 is between 2.245 and 2.885 GHz, wherein the operation bandwidth thereof is up to 640 MHz.

Figure 7A:
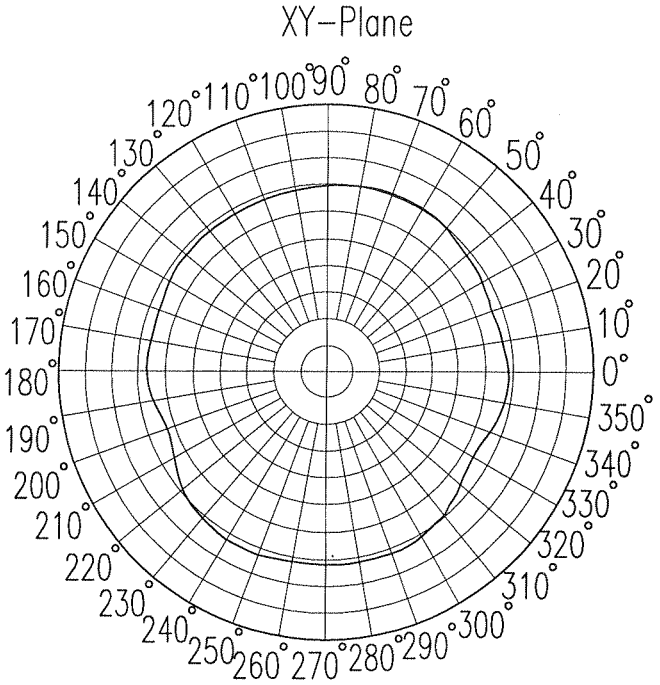
FIGS. 7(*a*)-7(*c*) show radiation patterns of an antenna according to an embodiment of the present invention.
Figure 7B:
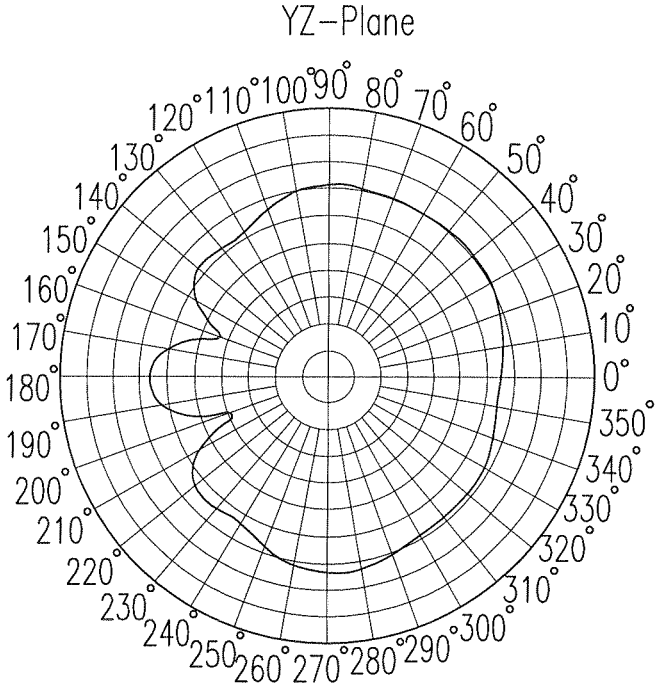
Figure 7C:
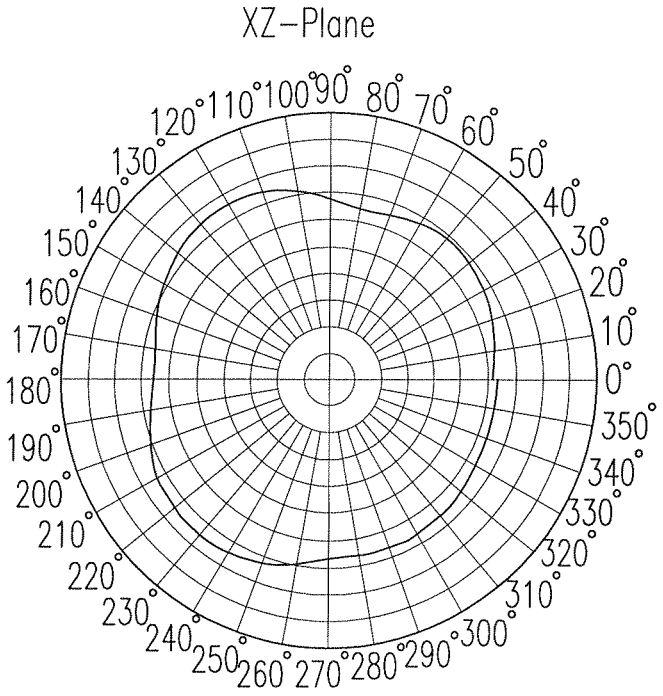

Please refer to FIGS. 7(*a*)-7(*c*), which show radiation patterns of the antenna 40 according to an embodiment of the present invention. The antenna 40 has a central operation frequency of 2.45 GHz. FIG. 7(*a*) shows the radiation pattern of the antenna 40 on the XY-Plane, FIG. 7(*b*) shows the radiation pattern of the antenna 40 on the YZ-Plane, and FIG. 7(*c*) shows the radiation pattern of the antenna 40 on the XZ-Plane. The antenna 40 measures the radiation gain thereof on the XY-Plane, the YZ-Plane and the XZ-Plane respectively in a way of 360-degree surrounding. As shown in FIGS. 7(*a*)-7(*c*), the radiation gain of the antenna 40 is very large and has a quite average distribution on an planes and in all directions.

Table 1 shows the peak gains and average gains of the antenna 40, the sample antenna 50 and the sample antenna 60 on the XY-Plane, the YZ-Plane and the ZX-Plane respectively. As shown in Table 1, the radiation gain of the antenna 40 is larger than those of the sample antenna 50 and the sample antenna 60.

TABLE 1

| Wi-Fi antenna (2.45 GHz) | | Antenna 40 | Sample antenna 50 | Sample antenna 60 |
|---|---|---|---|---|
| XY-Plane | Peak gain (dBi) | 1.62 | 2.66 | 3.73 |
| | Avg. gain (dBi) | −0.42 | −1.54 | −1.20 |
| YZ-Plane | Peak gain (dBi) | 2.17 | 0.57 | 0.99 |
| | Avg. gain (dBi) | −1.11 | −2.26 | −3.01 |
| ZX-Plane | Peak gain (dBi) | 3.51 | 2.14 | 2.89 |
| | Avg. gain (dBi) | 0.10 | −0.69 | −1.98 |

As shown in Table 1, the antenna of the present invention has not only a larger operation frequency but also a larger radiation gain than those of other PIFAs. In the manufacturing process of the antenna, the required antenna parameters are obtained by simply adjusting the widths of the respective adjusting portions of the antenna. More specifically, the antenna of the present invention has a broad operation bandwidth, which can reduce the frequency drift of the antenna under different environments. Therefore, the antenna of the present invention can be used under different environments without the further fine tuning of the frequency segment. Even if the antenna of the present invention is used under different environments, the frequency band thereof still efficiently falls within the operation frequency band. Hence, the multi-system share can be achieved without adjusting the frequency. This efficiently saves the cost of manufacturing, multiple molds. Besides, the antenna of the present invention is applicable to various kinds of wireless network devices.

EMBODIMENTS

1. A method for adjusting an operation bandwidth of an antenna, wherein the antenna is connected to an electronic device and includes a radiation element and a ground element, the radiation element includes a first adjusting portion having a first width and a second adjusting portion having a second width, the ground element includes a ground portion and a third adjusting portion having a third width, a first end and a second end, a first included angle is formed between the first adjusting portion and the second adjusting portion, the first adjusting portion extends, from the second adjusting portion, a second included angle is formed between the second adjusting portion and the third adjusting portion, the second adjusting portion extends from the first end of the third adjusting portion, a third included angle is formed between the third adjusting portion and the ground portion, the second end of the third adjusting portion extends from the ground portion, and the first adjusting portion is disposed between the ground portion and the second adjusting portion, the method comprising steps of:

obtaining an operation frequency of the antenna by setting a total width being a sum of the first width and the second width based on a relationship between a resonance wavelength of the antenna and a length of the radiation element;

adjusting an impedance matching between the antenna and the electronic device by adjusting the third width of the third adjusting portion based on the operation frequency; and adjusting the operation bandwidth of the antenna by fixing the total width and by adjusting the second width based on the operation frequency and the impedance matching.

2. The method of Embodiment 1, wherein the radiation element, further comprises a signal feeding terminal, the first adjusting portion has an edge, and the length of the radiation element is a sum of the total width and a first length from the signal feeding terminal to the edge of the first adjusting portion.

3. The method of any one of Embodiments 1-2, wherein the operation frequency is 2.45 GHz.

4. The method of any one of Embodiments 1-3, further comprising a step of:

setting a ratio of the second width to the first width to be 35 to enable the operation bandwidth to, be 640 MHz.

5. The method of any one of Embodiments 1-4, wherein a ratio of the second width to the sum is between 0.5 and 1.

6. The method of any one of Embodiments 1-5, wherein the ratio is 0.972.

7. A method for adjusting an operation bandwidth of an antenna, wherein the antenna includes a radiation element, and the radiation element includes a first adjusting portion having a first width and a second adjusting portion having a second width, the method comprising steps of:

seeking an operation frequency of the antenna; and adjusting the operation bandwidth of the antenna by adjusting the second width based on the operation frequency.

8. The method of Embodiment 7, wherein the radiation element further comprises a signal feeding terminal, the first adjusting portion has an edge, and the radiation element has a length being a sum of the total width and a first length from the signal feeding terminal to the edge of the first adjusting portion.

9. The method of any one of Embodiments 7-8, wherein the operation frequency is 2.45 GHz.

10. The method of any one of Embodiments 7-9, further comprising a step of:

setting a ratio of the second width to the first width to be 35 to enable the operation bandwidth to be 640 MHz.

11. The method, of any one of Embodiments 7-10, wherein a ratio of the second width to the sum is between 0.5 and 1.

12. The method of any one of Embodiments 7-11, wherein the ratio is 0.972.

13. An antenna having an operation frequency and an adjustable operation bandwidth, comprising:

a radiation element including:

a first adjusting portion having a first width; and a second adjusting portion having a second width, wherein the operation frequency is determined by a sum of the first width and the second width, and the adjustable operation bandwidth is determined by the second width.

14. The antenna of Embodiment 13, wherein a ratio of the second width to the first width is 35.

15. The antenna of any one of Embodiments 13-14, wherein the radiation element further comprises a signal feeding terminal, the first, adjusting portion has an edge, and the radiation element has a length being a sum of the total width and a first length from the signal feeding terminal to the edge of the first adjusting portion.

16. The antenna of any one of Embodiments 13-15, wherein the operation frequency is 2.45 GHz.

17. The antenna of any one of Embodiments 13-16, wherein a ratio of the second width to the first width is 35.

18. The antenna of any one of Embodiments 13-17, wherein a ratio of the second width to the sum is between 0.5 and 1.

19. The antenna of any one of Embodiments 13-18, wherein the ratio is 0.972.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so, as to encompass all such modifications and similar structures.

What is claimed is:

1. A method for adjusting an operation bandwidth of an antenna, the method comprising the following steps:

providing an antenna that is connected to an electronic device and that includes only one radiation element having a length and a ground element, the radiation element includes a first adjusting portion having a first outer edge, a first inner edge spaced from the first outer edge defining a first width and a second inner edge extending substantially transverse to the first inner edge toward the first outer edge, a second adjusting portion extending from the first adjusting portion and having a second outer edge extending from the first outer edge and a third inner edge extending at a first inclined angle from the second inner edge defining a second width, and a single feeding terminal protruding from the third inner edge of the second adjusting portion, and the ground element includes a ground portion and a third adjusting portion extending between the ground portion and the second adjusting portion and having a third outer edge extending from the second outer edge of the second adjusting portion, a fourth outer edge extending substantially transverse to the third outer edge and a fourth inner edge spaced from the fourth outer edge, extending from the third inner edge of the second adjusting portion at a second inclined angle and defining a third width, the single feeding terminal being located directly between the second inner edge of the first adjusting portion and the fourth inner edge of the third adjusting portion such that the single feeding terminal is the only element extending between the first adjusting portion and the third adjusting portion;

obtaining an operation frequency of the antenna by setting the length of the radiation element based on a specific ratio of a resonance wavelength of the antenna to the length of the radiation element;

adjusting an impedance matching between the antenna and the electronic device by adjusting the third width of the third adjusting portion based on the operation frequency; and adjusting the operation bandwidth of the antenna by fixing the total width and by adjusting a first ratio value and a second ratio value based on the operation frequency and the impedance matching, wherein the first ratio value equals the second width divided by the total width, and the second ratio value equals the second width divided by the first width, and wherein the second width of the second adjusting portion is the same at both sides of the single feeding terminal.

2. A method as claimed in claim 1, wherein the operation frequency is 2.45 GHz, and the specific ratio is 1:4.

3. A method as claimed in claim 1, further comprising a step of setting the second ratio value to 35 to enable the operation bandwidth to be 640 MHz.

4. A method as claimed in claim 1, wherein the first ratio value is between 0.5 and 1.

5. A method as claimed in claim 1, wherein the first ratio value is 0.972.

6. A method for adjusting an operation bandwidth of an antenna, the method comprising the following steps:

providing an antenna that includes a only one radiation element having a length that comprises a first adjusting portion having a first outer edge, a first inner edge spaced from the first outer edge defining a first width and a second inner edge extending substantially transverse to the first inner edge toward the first outer edge, a second adjusting portion extending from the first adjusting portion and having a second outer edge extending from the first outer edge and a third inner edge extending from the second inner edge and defining a second width, a single feeding terminal protruding from the third inner edge of the second adjusting portion and an intersection between the second inner edge and the third inner edge, the single feeding terminal and the intersection defining therebetween a first unobstructed length, wherein the length of the radiation element is equal to a sum of the first length a total width defined by combining the first width and the second width;

determining an operation frequency of the antenna; and adjusting the operation bandwidth of the antenna by adjusting a first ratio value and a second ratio value based on the operation frequency, wherein the first ratio value equals the second width divided by the total width, and the second ratio value equals the second width divided by the first width, and wherein the second width of the second adjusting portion is the same at both sides of the single feeding terminal.

7. A method as claimed in claim 6, wherein the operation frequency of the antenna is determined by adjusting the length of the radiation element, the second adjusting portion further includes a second edge having the second width and a third edge, the first width plus the second width equals a total width, the first edge extends toward the second edge to form a straight edge having the total width, and the second edge intersects with the third edge at the intersection corner.

8. A method as claimed in claim 6, wherein the operation frequency is 2.45 GHz.

9. A method as claimed in claim 6, further comprising a step of setting the second ratio value 35 to enable the operation bandwidth to be 640 MHz.

10. A method as claimed in claim 6, wherein the first ratio value is between 0.5 and 1.

11. A method as claimed in claim 6, wherein the first ratio value is 0.972.

12. An antenna having an operation frequency and an adjustable operation bandwidth, comprising:

a radiation element having a length, and including:

a first adjusting portion having a first width;

a second adjusting portion having a second width; and a ground element including a first ground terminal and a second ground terminal, wherein the operation frequency is determined by a total width summed by the first width and the second width, the adjustable operation bandwidth is determined by a first ratio value and a second ratio value, the first ratio value equals the second width divided by the total width, and the second ratio value equals the second width divided by the first width, and wherein the antenna has only one radiation element that includes a single feeding terminal extending from the second adjusting portion and an intersection, the first adjusting portion includes a first edge having the first width, and a first inner edge located between the single feeding terminal and the first edge, wherein the single feeding terminal and the intersection define therebetween a first length, and the length of the radiation element is equal to a sum of the first length and the total width, and wherein the second width of the second adjusting portion is the same at both sides of the single feeding terminal.

13. An antenna as claimed in claim 12, wherein the second ratio value is 35.

14. An antenna as claimed in claim 12, wherein the operation frequency of the antenna is determined by adjusting the length of the radiation element, the second adjusting portion further includes a second edge having the second width and a third edge, the first edge extends toward the second edge to form a straight edge having the total width, and the second edge intersects with the third edge at the intersection corner.

15. An antenna as claimed in claim 12, wherein the operation frequency is 2.45 GHz.

16. An antenna as claimed in claim 12, wherein the first ratio value is between 0.5 and 1.

17. An antenna as claimed in claim 16, wherein the first ratio value is 0.972.

18. An antenna as claimed in claim 12, wherein the ground element includes a ground portion and a third adjusting portion connected between the second adjusting portion and the ground portion, and wherein the second adjusting portion further includes a second straight inner edge connecting the first inner edge and the single feeding terminal and the first inner edge and the second inner edge include therebetween a first angle.

19. An antenna as claimed in claim 18, wherein the second adjusting portion further includes a third straight inner edge and the third adjusting portion includes a fourth inner edge, and wherein the third straight inner edge connects the single feeding terminal and the fourth inner edge and the third inner edge and the fourth inner edge include therebetween a second angle.

* * * * *